US005701853A

United States Patent [19]

Takahashi

[11] Patent Number: 5,701,853

[45] Date of Patent: Dec. 30, 1997

[54] OIL COOLING STRUCTURE FOR A VEHICLE

[75] Inventor: Atsuhiko Takahashi, Saitama, Japan

[73] Assignee: Honda Giken Kogyo Kabushiki Kaisha, Tokyo, Japan

[21] Appl. No.: 596,425

[22] Filed: Feb. 2, 1996

[30] Foreign Application Priority Data

Feb. 7, 1995 [JP] Japan ..... HEI 7-019408

[51] Int. Cl.[6] ..... F01P 11/08; F01M 5/00

[52] U.S. Cl. ..... 123/41.33; 123/196 AB; 184/104.3

[58] Field of Search ..... 123/196 AB, 41.33; 184/104.3

[56] References Cited

U.S. PATENT DOCUMENTS

| | | | |
|---|---|---|---|
| 2,781,859 | 2/1957 | Warren | 123/196 AB |
| 4,640,341 | 2/1987 | Ozawa | 123/41.33 |
| 4,687,069 | 8/1987 | Inomata et al. | 123/41.33 |
| 4,690,236 | 9/1987 | Shinozaki et al. | 123/41.33 |
| 4,971,171 | 11/1990 | Yamada et al. | 123/41.33 |
| 5,307,865 | 5/1994 | Inagaki et al. | 123/196 AB |

FOREIGN PATENT DOCUMENTS

| | | | |
|---|---|---|---|
| 61-1536 | 1/1986 | Japan . | |
| 3168316 | 7/1991 | Japan | 123/41.33 |
| 464915 | 10/1992 | Japan . | |
| 709742 | 6/1954 | United Kingdom | 123/196 AB |

*Primary Examiner*—Erick R. Solis

[57] ABSTRACT

To provide a motorcycle including a cooler disposed in such a manner so as to arcuately cover the front surface and the right and left side surfaces of a head pipe, wherein conduits connected to the cooler are disposed so as to prevent the need to reduce the capacity of a fuel tank and to prevent a thermal effect caused by the heated coolant. A cooler is provided on a head pipe positioned in front of a fuel tank. A first conduit for supplying coolant from the right side surface of an engine is connected to the upper surface of the right end of the cooler. A second conduit connected to the upper surface of the left end of the cooler passes along the upper surface of the cooler so as not to interfere with the fuel tank, and is connected to the right side surface of a tank. Wires and wiring cords extending from the steering handle extend along the left side surface of the head pipe to avoid the thermal effect of coolant at a high temperature.

19 Claims, 5 Drawing Sheets

OIL COOLING STRUCTURE FOR A VEHICLE

BACKGROUND OF THE INVENTION

1. Field of the Invention

The present invention relates to an oil cooling structure for a motorcycle or a cycle car. More specifically, an oil cooler is positioned to cover a front surface and right and left side surfaces of a head pipe positioned in front of a fuel tank. An outlet for the coolant of an engine is connected to the inlet of the oil cooler by means of a first conduit. The inlet for the coolant to the engine is connected to the outlet of the oil cooler by means of a second conduit.

2. Description of Background Art

An oil cooling structure for a motorcycle is disclosed in Japanese Patent Publication No. Hei 4-64915. In this disclosure, a first oil conduit connects an engine to one of the right and left ends of an oil cooler. A second oil conduit connects an oil tank to the other end of the oil cooler. The conduits may interfere with a fuel tank positioned near the oil cooler. As a result, in some cases, the capacity of the fuel tank is inevitably reduced for avoiding interference with the conduits. Furthermore, since high temperature oil passes through the conduits, the conduits are heated. Thus, wires and wiring cords disposed near the conduits are required to be covered with protective tubes to protect the wires and wiring cords from the thermal effect of the heated oil.

SUMMARY OF THE INVENTION

In view of the foregoing, the present invention provides an oil cooling structure in which conduits connected to an oil cooler are so arranged so as to eliminate the reduction in capacity of a fuel tank and to prevent a thermal effect caused by the oil at a high temperature.

To achieve the above object, according to a preferred embodiment of the present invention, there is provided an oil cooling structure for a motorcycle and a cycle car which includes an oil cooler disposed in such a manner so as to cover the front surface and the right and left side surfaces of a head pipe positioned in front of a fuel tank and a first conduit for connecting the output for the coolant of the engine to the inlet of the oil cooler. A second conduit is provided for connecting the inlet for the coolant for the engine to the outlet of the oil cooler wherein at least one of the first conduit and the second conduit is disposed in such a manner as to extend along the upper surface or the lower surface of the oil cooler.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

With the above configuration, at least one of the first conduit and the second conduit is disposed along the upper surface or the lower surface of the oil cooler designed to cover the front surface and the right and left side surfaces of a head pipe. Accordingly, it becomes possible to reduce the size of at least one of the first and the second conduits and the oil cooler for preventing the conduits from interfering with a fuel tank, and to ensure near the oil cooler, a space for containing wires and wiring cords.

Figure 1:
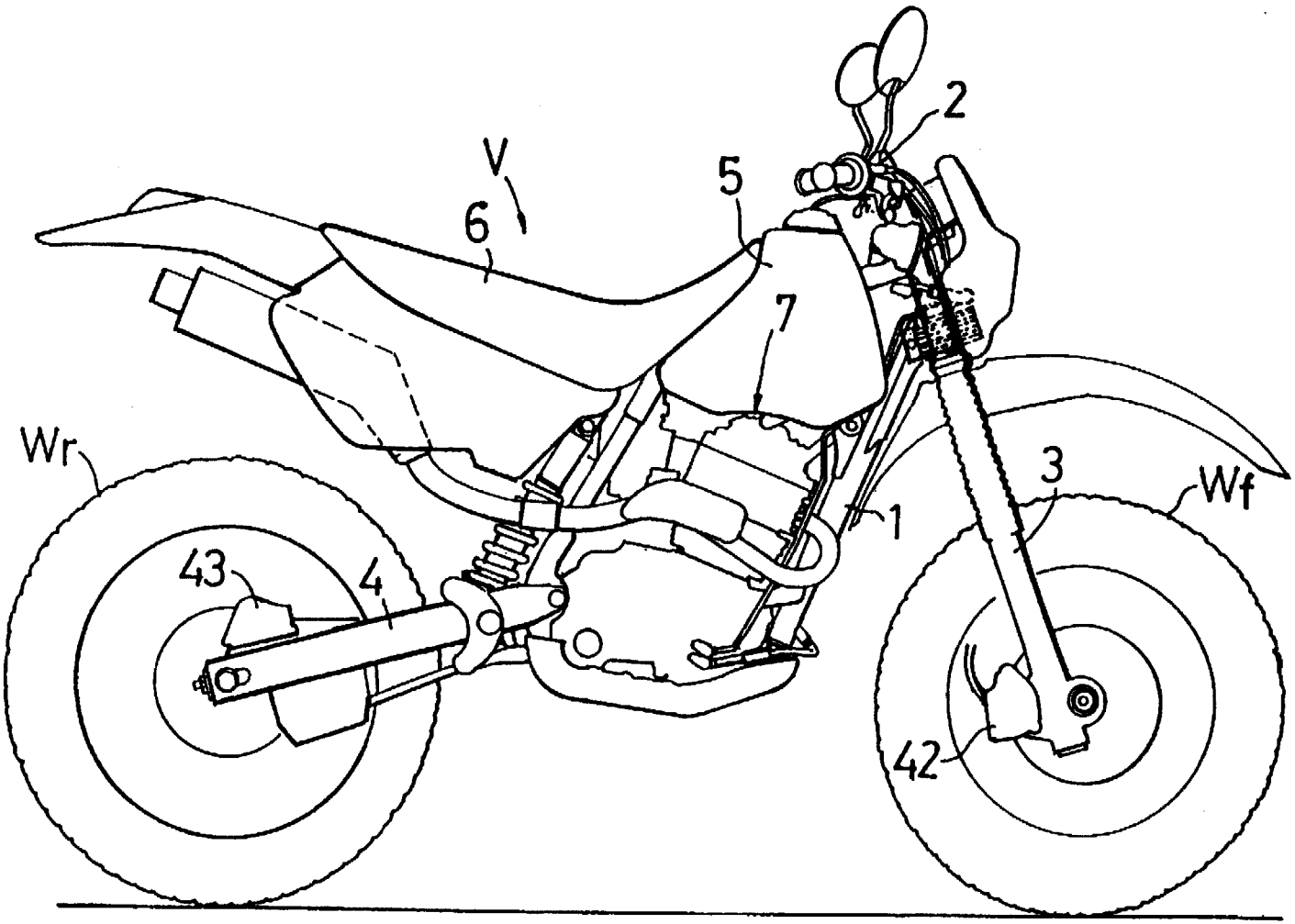
FIG. 1 is a side view of the entire configuration of a motorcycle.

Hereinafter, one embodiment of the present invention will be described with reference to FIGS. 1 to 5. Referring to FIG. 1, a front fork 3 is pivotably supported by the front portion of a body frame 1 of a motorcycle V in such a manner as to be turnable right and left. The front fork 3 includes a steering handle 2 at the upper end, and rotatably supports a front wheel Wf at the lower end. A rear fork 4 is pivotably supported by the rear portion of the body frame 1 in such a manner as to be vertically rockable. The rear fork 4 rotatably supports a rear wheel Wr at the rear end. A fuel tank 5 and a seat 6 are supported on the upper portion of the body frame 1. An engine 7 is provided for driving the rear wheel Wr and is supported by the lower portion of the body frame 1.

Figure 2:
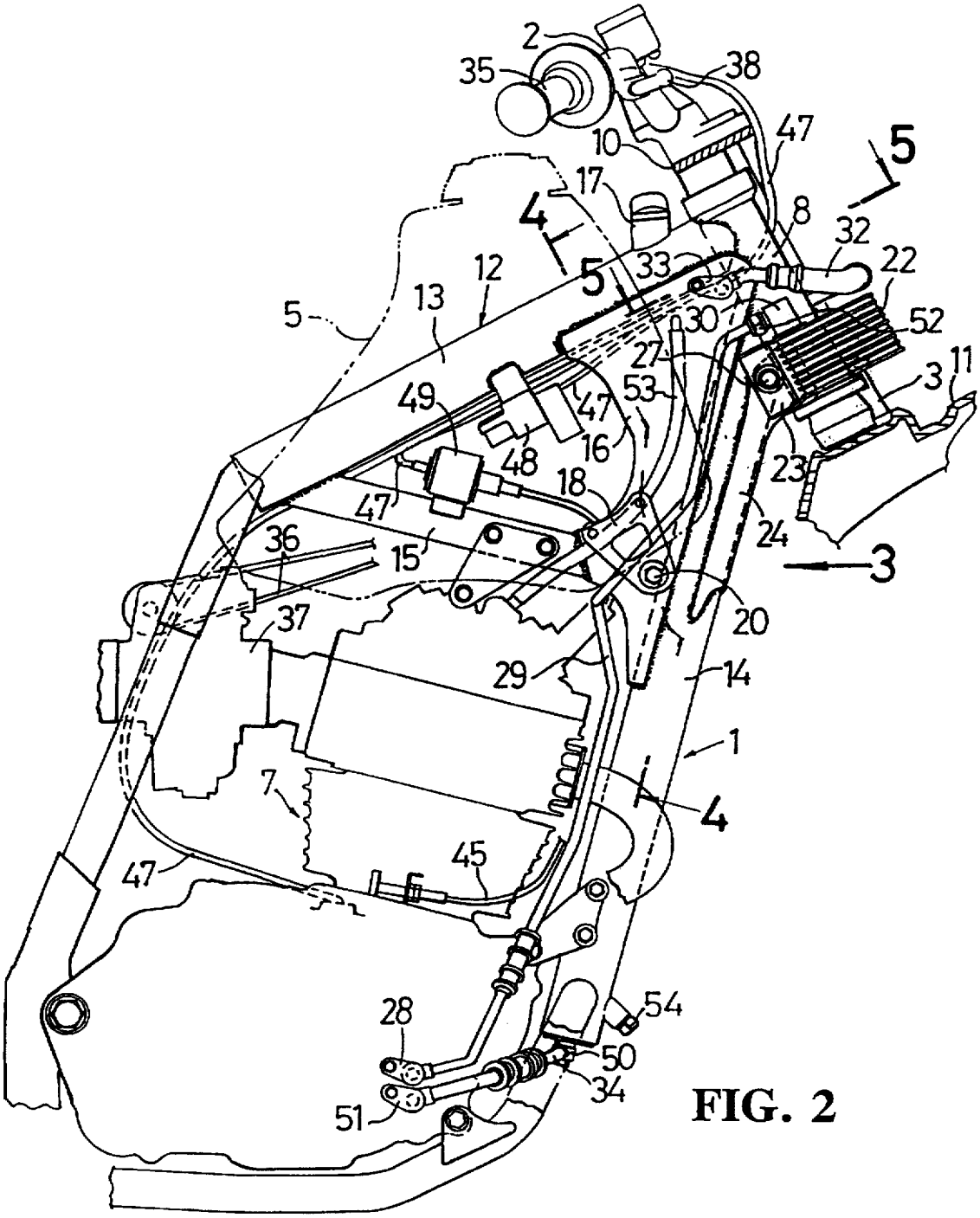
FIG. 2 is an enlarged view of essential portions of FIG. 1.
Figure 3:
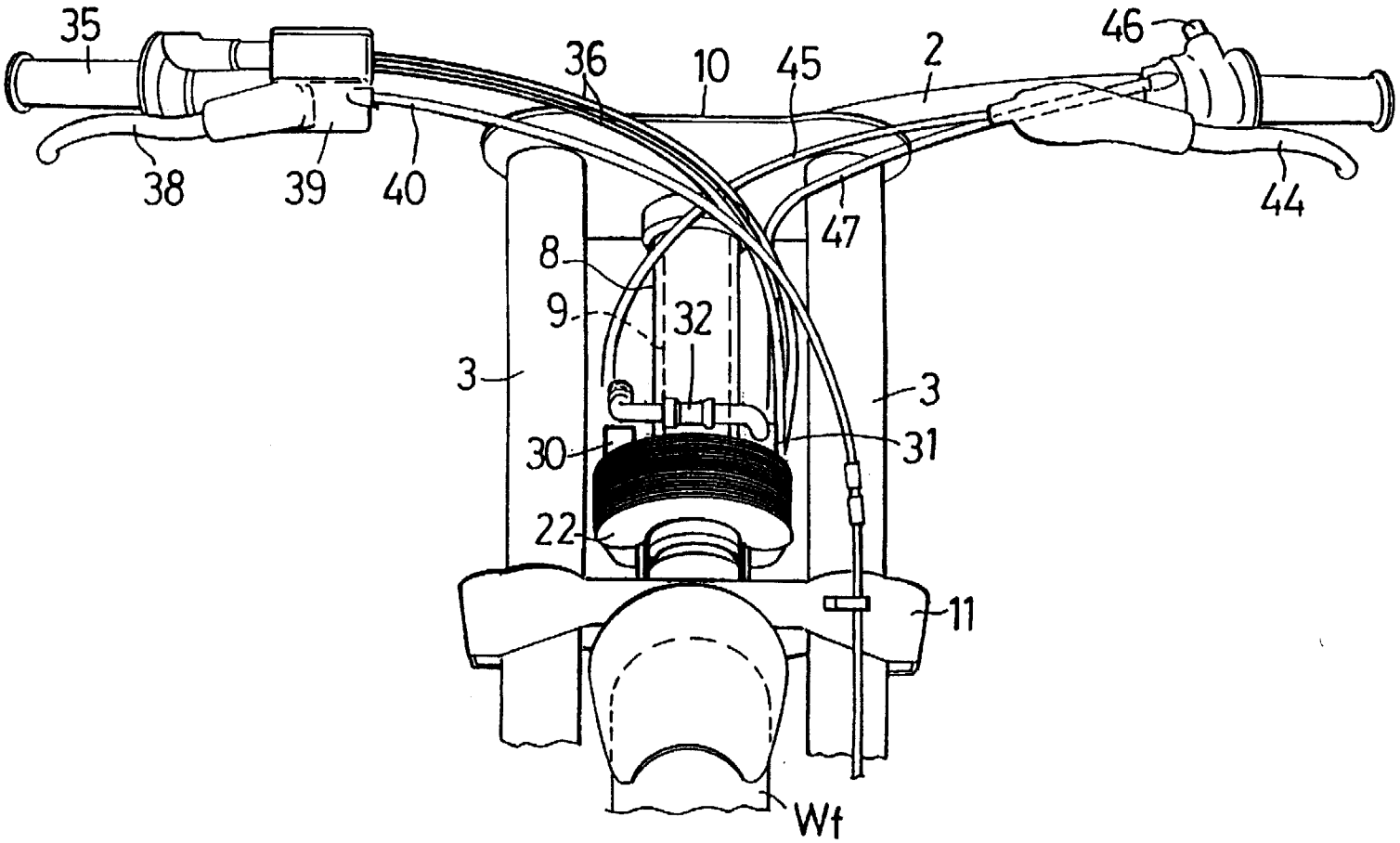
FIG. 3 is a view taken in the direction of the arrow 3 of FIG. 2.
Figure 4:
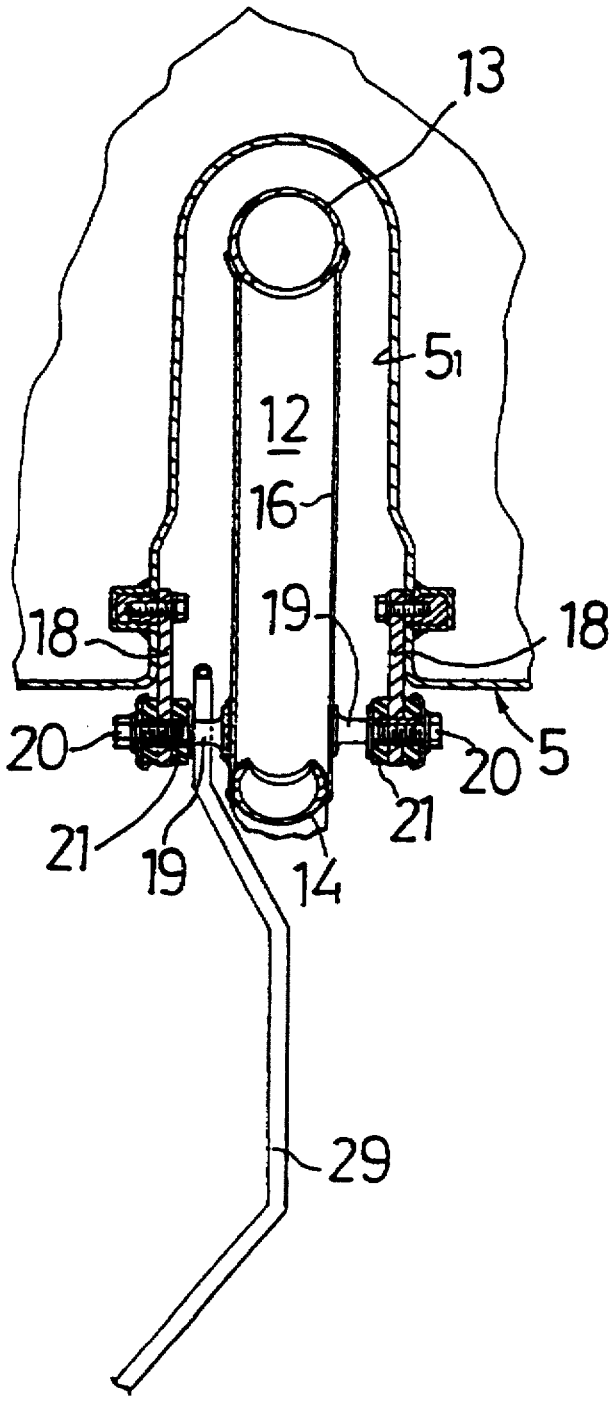
FIG. 4 is a sectional view taken along line 4—4 of FIG. 2.

As is apparent from FIGS. 2 and 3, a steering shaft 9 is rotatably supported by the head pipe 8 provided at the front end of the body frame 1. A top bridge 10 and a bottom bridge 11 are respectively provided on the upper end and the lower end of the steering shaft 9. The front fork 3 is supported by the top bridge 10 and the bottom bridge 11, and the steering handle 2 is supported by the top bridge 10.

The front portion of the body frame 1 constitutes an oil tank 12 for containing oil for the engine 7. The oil tank 12 is composed of the interior of a main pipe 13 extending rearwardly from the head pipe 8, the interior of a down-tube 14 extending downwardly from the head pipe 8, the interior of a stay 15 for connecting the rear end of the main pipe 13 to the intermediate portion of the down-tube 14, and the interior of a gusset 16 for connecting the main pipe 13 to the down-tube 14, which are communicated to each other.

An oil supply port 17 for supplying oil to the oil tank 12 is provided at the front end of the main pipe 13. As is apparent from FIGS. 1, 3 and FIG. 4, a recessed portion $5_1$ formed in an inverted U-shape is formed in the lower surface of the fuel tank 5. The fuel tank 5 is disposed such that the recessed portion $5_1$ crosses the main pipe 13. A pair of right and left brackets 18, 18 are each fixed on both inner sides of the recessed portion $5_1$ of the fuel tank 5. The brackets 18, 18 are each supported by rubber bushings 21, 21 fixed by means of bolts 20, 20 to supporting pins 19, 19 welded on the right and left surfaces of the gusset 16.

Figure 5:
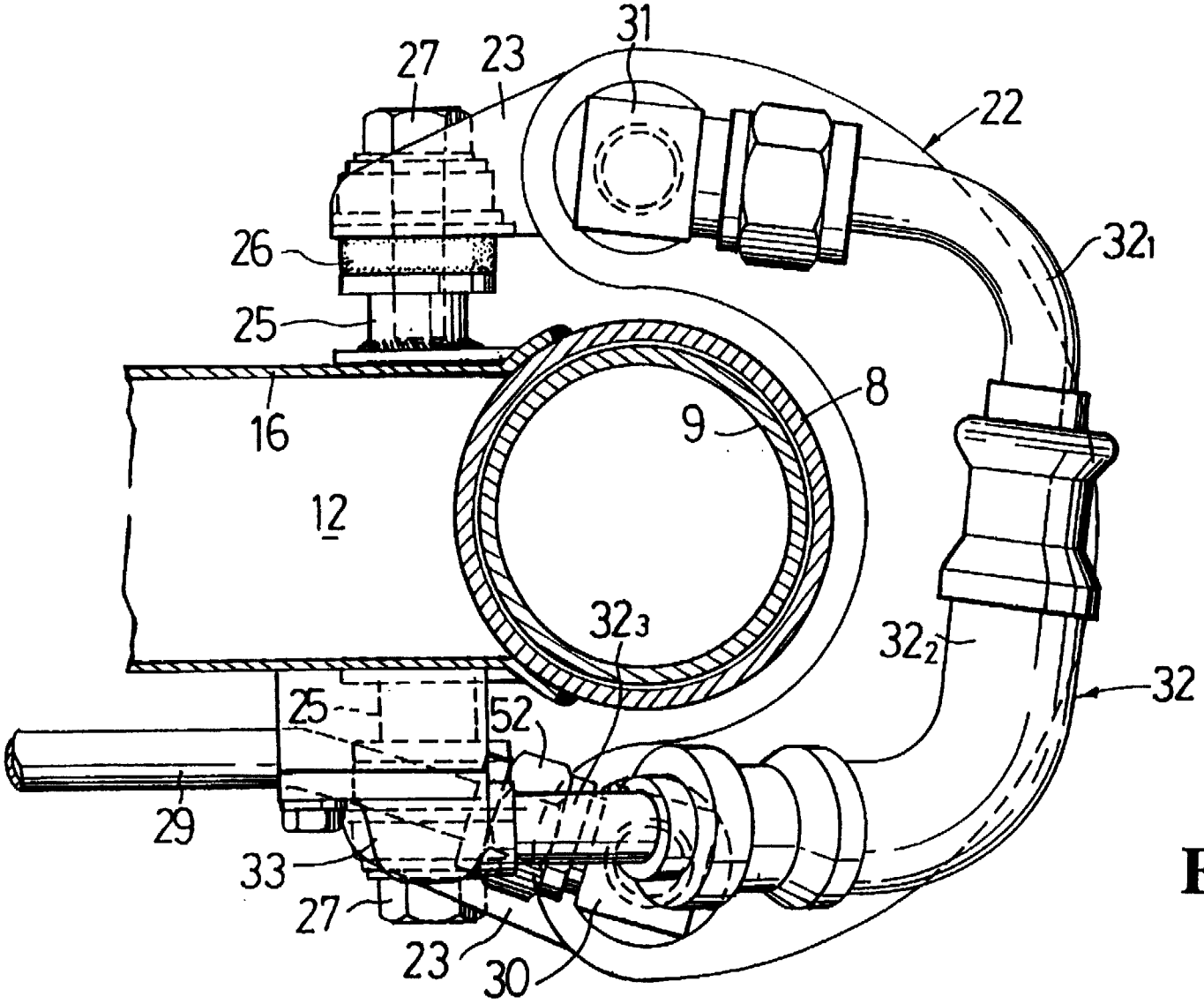
FIG. 5 is an enlarged sectional view taken along line 5—5 of FIG. 2.

As shown in FIGS. 2, 3 and 5, an oil cooler 22 for cooling oil is disposed in such a manner so as to cover the front surface and the right and left side surfaces of the head pipe 8. The oil cooler 22 is curved in an arcuate shape in a plan view, and is formed at the front portion with a plurality of cooling fins extending in the circumferential direction. Brackets 23, 23 are each provided at the right and left ends of the oil cooler 22 in such a manner as to project rearwardly therefrom. A pair of right and left supporting pins 25, 25 are welded on the gusset 24 for connecting the head pipe 8 to the down-tube 14. The brackets 23, 23 of the oil cooler 22 are each fitted to the supporting pins 25, 25 through rubber bushings 26, 26 by means of bolts 27, 27.

A first conduit 29 rises upwardly along the right side surface of the down-tube 14 from a joint 28 provided on the right side surface of the engine 7, and it is connected to a joint 30 as an oil inlet provided on the upper surface of the right end of the oil cooler 22 by means of a connecting bolt 52. A second conduit 32 is connected to a joint 31 as an oil outlet provided on the upper surface of the left end of the oil cooler 22. The second conduit 32 includes a steel pipe $32_1$, a flexible pipe $32_2$ made of a flexible material such as rubber, and a steel pipe $32_3$, which are connected in series to each other. The second conduit 32 is curved in an arcuate shape from the left side to the right side of the vehicular body along the upper surface of the oil cooler 22 and is connected to a joint 33 provided on the right side surface of the gusset 16. A joint 50 provided on the lower end of the oil tank 12, that is, on the right side surface of the lower end of the down-tube 14 is connected to a joint 51 provided on the right side surface of the engine 7 by means of a third conduit 34. In FIG. 2, a breather pipe 53 and a drain plug 54 are provided.

In the case where the upper end of the first conduit 29 is intended to be mounted on or dismounted from the joint 30 provided on the upper surface of the right end of the oil cooler 22, the joint 33 at the right end of the second conduit 32 may be removed from the right side surface of the gusset 16 and the flexible pipe $32_2$ of the second conduit 32 may be curved upwardly. With this operation, a space for operating the connecting bolt 52 for connecting the first conduit 29 to the joint 30 can be ensured, resulting in improved workability.

A loop-like throttle wire 36 extending from a throttle grip 35 provided at the right end of the steering handle 2 bypasses the left side surface of the head pipe 8 from the front surface thereof, passing through the recessed portion $5_1$ of the fuel tank 5, and is connected to a carburetor 37 provided on the rear portion of a cylinder head of the engine 7. A brake hose 40, which is operated by a brake lever 38 provided at the right end of the steering handle 2, extends from a master cylinder 39, passing in front of the head pipe 8 and in front of the left portion of the front fork 3, and is connected to a brake caliper 42 of the front wheel Wf (see FIG. 1).

A clutch wire 45 extends from a clutch lever 44 provided at the left end of the steering handle 2. It bypasses the right side surface of the head pipe 8 from the front surface thereof, extends along the rear surface of the down-tube 14, and is connected to a clutch (not shown) provided on the right side surface of the engine 7. A wiring cord 47 extending from a key switch 46 provided at the right end of the steering handle 2, passes along the left side surface of the head pipe 8, and is connected to a CDI unit 48, an ignition coil 49 and the engine 9. Oil at a high temperature is supplied from the engine 7 to the right end of the oil cooler 22 through the first conduit 29 by means of an oil pump (not shown), and is cooled during passage within the oil cooler 22 from the right side to the left side of the vehicular body. The cooled oil flows in the second conduit 32 from the left end of the oil cooler 22, flowing from the left side to the right side of the vehicular body along the upper surface of the oil cooler 22, and is supplied from the right side surface of the gusset 16 to the oil tank 12. The oil in the oil tank 12 is supplied again to the engine 7 through the third conduit 34.

As described above, in this embodiment, the second conduit 32 is disposed along the upper surface of the oil cooler 22 for covering the front surface and the right and left side surfaces of the head pipe 8. Accordingly, it is not required to reduce a capacity of the fuel tank 5 disposed in back of the head pipe 8 for avoiding interference with the second conduit 32. Furthermore, since the first conduit 29 and the second conduit 32 are not disposed on the left side of the head pipe 8, it becomes possible to reduce the thermal effect of oil at a high temperature which is exerted on the throttle wire 36, brake hose 40 and wiring cord 47 passing along the left side of the head pipe 8.

The clutch wire 45 extending from the clutch lever 44 provided on the left side of the steering handle 2 passes along the right side of the head pipe 8 to avoid abrupt curving. However, the thermal effect of the oil at a high temperature on the clutch wire 45 may be avoided by disposing the clutch wire 45 upwardly from the throttle wire 36 and the brake hose 40, that is, by disposing the clutch wire 45 apart from the oil cooler 22 and the second conduit 32.

While the preferred embodiment of the present invention has been described in detail, such description is for illustrative purposes only, and it is to be understood that changes and modifications may be made without departing from the spirit of the present invention.

For example, in the embodiment described herein, the first conduit 29 is provided along the upper surface of the oil cooler 22. However, the conduit may be disposed along the lower surface of the oil cooler 22. Moreover, the second conduit 32 or both the first and second conduits 29, 32 may be disposed along the upper surface or the lower surface of the oil cooler 22.

It is to be noted that the present invention may be applied to a cycle car, other than the motorcycle V described in this embodiment.

As described above, at least one of a first conduit and a second conduit is disposed along the upper surface or the lower surface of an oil cooler disposed for covering the front surface and the right and left side surfaces of a head pipe, so that at least one of the first and second conduits and the oil cooler can be reduced in size. This makes it possible not only to avoid a reduction in the capacity of a fuel tank due to interference with the above conduits, but also reduces the thermal effect of oil at a high temperature which is exerted on wires and wiring cords by ensuring a space containing the wires and wiring cords near the oil cooler.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cooling structure for a vehicle comprising:

a cooler positioned to cover a front surface and right and left side surfaces of a head pipe positioned in front of a fuel tank;

a first conduit for connecting an output for a coolant for an engine to an inlet of said cooler; and a second conduit for connecting an inlet for a coolant for the engine to an outlet of said cooler;

wherein at least one of said first conduit and said second conduit extends along an upper surface of said cooler and past said right side surface, said front surface, and said left side surface of said head pipe, and wherein said cooler is connected to a coolant tank for receiving cooled coolant prior to being supplied to said engine.

2. The cooling structure for a vehicle according to claim 1, wherein said cooler is substantially U-shaped and includes a central portion with side sections projecting therefrom, said central portion of said cooler being positioned adjacent to a forward portion of the head pipe and said side sections projecting therefrom being positioned adjacent to side portions of the head pipe, said side sections each including a fastening bracket at an end thereof for attachment to opposing sides of a frame member attached to said head pipe.

3. The cooling structure for a vehicle according to claim 1, wherein said first conduit is in fluid communication from said output for the coolant from the engine to said inlet of said cooler positioned on an upper surface of the cooler for supplying heated coolant from said engine to said cooler.

4. The cooling structure for a vehicle according to claim 1, wherein said second conduit is in fluid communication from said output for the coolant position on the upper surface of the cooler to said inlet for the coolant to said engine for supplying cooled coolant from said cooler to said engine.

5. The cooling structure for a vehicle according to claim 1, wherein said coolant tank includes portions of a frame member of said vehicle for receiving cooled coolant from said cooler and communicating the cooled coolant to a point adjacent to said engine for supply thereto, said frame member having opposed first and second sides, said first conduit and said second conduit each being routed past said second side of said frame member.

6. The cooling structure for a vehicle according to claim 1, wherein said second conduit includes a first section connected by a joint to said outlet for said cooler, a second section connected to said coolant tank and an intermediate section for providing fluid communication between said first and second sections, said second conduit being substantially U-shaped around said head pipe.

7. The cooling structure for a vehicle according to claim 2, further comprising a supporting pin located on each of said opposing side members of said frame, a pair of elastic bushings, and a pair of fasteners for attaching said brackets to said supporting pins with said elastic bushings sandwiched therebetween.

8. A cooling structure for a vehicle comprising:

a cooler positioned to cover a front surface and right and left side surfaces of a head pipe positioned in front of a fuel tank;

a first conduit for connecting an output for a coolant for an engine to an inlet of said cooler; and a second conduit for connecting an inlet for a coolant for the engine to an outlet of said cooler;

wherein at least one of said first conduit and said second conduit extends along a lower surface of said cooler and past said right side surface, said front surface, and said left side surface of said head pipe, and wherein said cooler is connected to a coolant tank for receiving cooled coolant prior to being supplied to said engine.

9. The cooling structure for a vehicle according to claim 8, wherein said cooler is substantially U-shaped and includes a central portion with side sections projecting therefrom, said central portion of said cooler being positioned adjacent to a forward portion of the head pipe and said side sections projecting therefrom being positioned adjacent to side portions of the head pipe, said side sections each including a fastening bracket at an end thereof for attachment to opposing sides of a frame member attached to said head pipe.

10. The cooling structure for a vehicle according to claim 8, wherein said first conduit is in fluid communication from said output for the coolant from the engine to said inlet of said cooler positioned on a lower surface of the cooler for supplying heated coolant from said engine to said cooler.

11. The cooling structure for a vehicle according to claim 8, wherein said second conduit is in fluid communication from said output for the coolant position on the lower surface of the cooler to said inlet for the coolant to said engine for supplying cooled coolant from said cooler to said engine.

12. The cooling structure for a vehicle according to claim 8, wherein said coolant tank includes portions of a frame member of said vehicle for receiving cooled coolant from said cooler and communicating the cooled coolant to a point adjacent to said engine for supply thereto, said frame member having opposed first and second sides, said first conduit and said second conduit each being routed past said second side of said frame member.

13. The cooling structure for a vehicle according to claim 8, wherein said second conduit includes a first section connected by a joint to said outlet for said cooler, a second section connected to said coolant tank and an intermediate section for providing fluid communication between said first and second sections, said second conduit being substantially U-shaped around said head pipe.

14. A cooling structure for a motorcycle including a head pipe having a front surface and right and left side surfaces, a frame structure, a fuel tank and an engine comprising:

a cooler having an upper surface, a lower surface and being positioned to cover said front surface and right and left side surfaces of said head pipe positioned adjacent to said fuel tank;

a first conduit for connecting an output for a coolant for said engine to an inlet of said cooler; and a second conduit for connecting an inlet for said coolant for the engine to an outlet of said cooler;

wherein at least one of said first conduit and said second conduit extends along at least one of said upper surface and said lower surface of said cooler and past said right side surface, said front surface, and said left side surface of said head pipe, and wherein said cooler is connected to a coolant tank for receiving cooled coolant prior to being supplied to said engine.

15. The cooling structure for a motorcycle according to claim 14, wherein said cooler is substantially U-shaped and includes a central portion with side sections projecting therefrom, said central portion of said cooler being positioned adjacent to a forward portion of the head pipe and said side sections projecting therefrom being positioned adjacent to side portions of the head pipe, said side sections each including a fastening bracket at an end thereof for attachment to opposing sides of a frame member attached to said head pipe.

16. The cooling structure for a motorcycle according to claim 14, wherein said first conduit is in fluid communication from said output for the coolant from the engine to said inlet of said cooler positioned on at least one of said upper surface and said lower surface of the cooler for supplying heated coolant from said engine to said cooler.

17. The cooling structure for a motorcycle according to claim 14, wherein said second conduit is in fluid communication from said output for the coolant position on at least one of said upper surface and said lower surface of the cooler to said inlet for the coolant to said engine for supplying cooled coolant from said cooler to said engine.

18. The cooling structure for a motorcycle according to claim 14, wherein said tank is formed in portions of said frame member of said motorcycle for receiving cooled coolant from said cooler and communicating the cooled coolant to a point adjacent to said engine for supply thereto.

19. A cooling structure for a motorcycle including a head pipe having a front surface and right and left side surfaces, a frame structure, a fuel tank and an engine comprising:

a cooler having an upper surface, a lower surface and being positioned to cover said front surface and right and left side surfaces of said head pipe positioned adjacent to said fuel tank;

a first conduit for connecting an output for a coolant for said engine to an inlet of said cooler; and a second conduit for connecting an inlet for said coolant for the engine to an outlet of said cooler;

wherein at least one of said first conduit and said second conduit extends along at least one of said upper surface and said lower surface of said cooler and past said right side surface, said front surface, and said left side surface of said head pipe, and wherein said cooler is substantially U-shaped and includes a central portion with side sections projecting therefrom, said central portion of said cooler being positioned adjacent to a forward portion of the head pipe and said side sections projecting therefrom being positioned adjacent to side portions of the head pipe, said side sections each including a fastening bracket at an end thereof for attachment to opposing sides of a frame member attached to said head pipe, and further comprising a supporting pin located on each of said opposing side members of said frame, a pair of elastic bushings, and a pair of fasteners for attaching said brackets to said supporting pins with said elastic bushings sandwiched therebetween; and a coolant tank connected to said cooler for receiving cooled coolant prior to being supplied to said engine, said coolant tank being formed in portions of said frame member of said motorcycle for receiving cooled coolant from said cooler and communicating the cooled coolant to a point adjacent to said engine for supply thereto, said frame member having opposed first and second sides, said first conduit and said second conduit each being routed past said second side of said frame member.

* * * * *